US005546774A

United States Patent [19]

Thompson et al.

[11] Patent Number: 5,546,774

[45] Date of Patent: Aug. 20, 1996

[54] PRE-RINSE DISPENSER

[75] Inventors: Matilda Thompson, R.D. 2, Box 420 Eighty Four, Pa. 15330; W. Grey Williams, Pittsburgh, Pa.

[73] Assignee: Matilda Thompson, Eighty Four, Pa.

[21] Appl. No.: 369,095

[22] Filed: Jan. 5, 1995

[51] Int. Cl.[6] ..... D06F 39/08

[52] U.S. Cl. ..... 68/208; 4/686; 68/902; 134/115 R; 137/264; 137/577; 137/590

[58] Field of Search ..... 68/208, 902; 134/115 R; 4/686, 688, 689, 691, 693; 137/264, 577, 590

[56] References Cited

U.S. PATENT DOCUMENTS

| | | | |
|---|---|---|---|
| 170,709 | 12/1875 | Carr | 4/686 |
| 316,057 | 4/1885 | Pitt | 4/686 |
| 1,166,303 | 12/1915 | Adams | 4/693 |
| 2,263,963 | 11/1941 | Barry | 137/577 X |
| 2,721,574 | 10/1955 | Parker | 68/902 X |
| 2,786,483 | 3/1957 | Warhus | 68/902 X |
| 2,877,788 | 3/1959 | Clark | 68/902 X |
| 2,884,947 | 5/1959 | Gerhardt | 68/902 X |
| 2,920,469 | 1/1960 | Henshaw, Jr. | 68/902 X |
| 2,988,755 | 6/1961 | Roland | 137/577 X |
| 4,495,960 | 1/1985 | Cartier et al. | 68/902 X |
| 4,648,140 | 3/1987 | Bogusz | 134/115 R X |
| 5,241,843 | 9/1993 | Hein | 68/902 X |

FOREIGN PATENT DOCUMENTS

| | | | |
|---|---|---|---|
| 163678 | 6/1955 | Australia | 68/902 |
| 54-69263 | 6/1979 | Japan | 68/902 |
| 957580 | 5/1964 | United Kingdom | 68/902 |

*Primary Examiner*—Philip R. Coe
*Attorney, Agent, or Firm*—Buchanan Ingersoll, P.C.; Robert J. Pugh

[57] ABSTRACT

A dispenser device for use with an automatic washing machine and a wash tub having a drain. The device has an elongated housing having a drain passage disposed therethrough. The housing has a first end provided with a first opening and a second end provided with a second opening, with both openings being connected to the drain passage. A sealing gasket is provided at the second end of the housing around the second opening. A means for mounting the device within the wash tub and means for selectably placing the device into a sealed and an unsealed position are also provided. When the device is in the sealed position, the gasket makes sealing contact with the wash tub around the wash tub drain. Thus, when sealed, fluid that enters the first opening travels through the drain passage and down the wash tub drain, while fluid that enters the wash tub is stored in the wash tub and is prevented from travelling down the wash tub drain. When the device is in the unsealed position, the gasket is separated from the wash tub such that fluid that enters the wash tub and fluid that enters the first opening travel down the wash tub drain.

17 Claims, 3 Drawing Sheets

PRE-RINSE DISPENSER

BACKGROUND OF THE INVENTION

1. Field of the Invention

This invention relates to a device that semiautomatically saves water that is discharged from an automatic clothes washing machine and alternatively allows the discharged water to travel down the drain.

2. Description of the Prior Art

Many attempts have been made over the years to recycle water discharged from washing machines for use in a subsequent wash. For example, U.S. Pat. No. 2,721,574 to Parker is directed towards such a water recycling device. This device involves a storage tank and a discharge tube permanently connected to the storage tank. Thus, the device may not be detached easily when it is not in use. Furthermore, the device utilizes a storage tank in addition to a washer tub. Similarly, U.S. Pat. No. 2,786,483 to Warhus, U.S. Pat. No. 2,877,788 to Clark and Japanese Patent No. 54-69263 all disclose means for recycling wash water which involve the use of such an additional storage tank.

Australian Patent No. 163678 discloses a washing machine water recycling device that engages directly with the drain of a washer tub, shown best in FIG. 2. This device has a tubular extension which must be physically and permanently connected to the hardware of the washer tub drainage pipe downstream of the drain hole of the tub. The drain hole of the tub is then stopped or sealed such that water may be stored in the washer tub or diverted directly down the drain through the tubular extension.

U.S. Pat. No. 4,495,960 to Cartier et al. discloses a fluid return valve for an automatic washer which may be clipped or otherwise held to the side of a washer tub. The fluid return valve disclosed in this reference does not sealable engage with the washer tub drain hole thus, washer discharge fluid may not be simultaneously stored within a washer tub while other washer fluid is drained down that washer tub. Thus, a second washer tub must be utilized for the disposal of washer fluid.

U.S. Pat. No. 2,920,469 Henshaw discloses a system for storing and reusing wash water. The system, shown best in FIG. 2, includes two hoses exiting from the washing machine, a storage hose and a drain hose. The storage hose empties into a storage tub while the drain hose empties into a specially designed drain hole which is elevated above the bottom surface of the storage tub. Such a design is impractical in that other than by suction induced through the storage hose, there is no easy way to remove water stored in the washer tub around the elevated drain. In addition, the drain is permanently mounted to the washer tub in an elevated position, thus making the washer tub impractical for other uses.

Therefore, there is a need in the art to develop a device for recycling wash and/or rinse water from an automatic washing machine that is simple and does not require a separate storage receptacle in addition to a washer tub. There is further a need for such a device that is portable and not permanently fixed to a washer tub and that is, therefore, removable and reusable.

SUMMARY OF THE INVENTION

I provide a dispenser device for use with an automatic washing machine and a wash tub having a drain. The washing machine is the type that is operable through a sequence of washing operations in a wash cycle. The present preferred device does not require a separate storage receptacle. Further, the device may be attached, detached and reattached to the washer tub easily so as to be portable.

The dispenser device has an elongated housing having first and second ends. The housing has a receiving opening at its first end and an engagement opening at its second end. A drain passage is disposed through the housing that connects to the receiving opening and engagement opening of the housing. A sealing gasket is provided at the second end of the housing around the engagement opening of the housing.

The device is capable of being placed into sealed or unsealed positions. When the device is placed into the sealed position, the sealing gasket contacts and makes a seal with the wash tub around the wash tub drain. With the sealing gasket thus placed around the tub drain, fluid that enters the receiving opening of the housing travels through the drain passage, out of the engagement opening and down the wash tub drain. Also, when the sealing gasket is thus sealingly positioned around the tub drain, fluid that enters the wash tub is stored in the wash tub and prevented from travelling down the wash tub drain by the device.

When the device is placed in the unsealed position, the sealing gasket is separated from the wash tub and the wash tub drain. With the sealing gasket removed from contact with the wash tub, fluid that enters either the wash tub or the receiving opening of the housing travels down the wash tub drain.

The preferred means for placing the device into the sealed and unsealed positions involves a guide rod and a lever handle. The elongated guide rod has a first end and a second end and is disposed within the housing with the guide rod and the housing being movable with respect to one another. The second end of the guide rod is positioned upon the drain of the washer tub either directly or by having an anchor connected to the guide rod second end that is positioned upon the tub drain. The lever handle is pivotally connected to the first end of the guide rod and a portion of the lever handle contacts the housing when the lever handle is pivoted. Thus, when the lever handle is pivoted, the guide rod second end maintains contact with the tub drain and the lever handle contacts the housing, lifting the housing and moving the sealing gasket away from the tub drain.

The device is mounted within the wash tub by any convenient means. Thus, it is preferred that the guide rod remain fixed relative to the wash tub and the housing moves relative to the guide rod and wash tub. Therefore, the means for mounting the device within the wash tub preferably secures the device in a position with the wash tub, yet allows the housing to be moved away from the bottom surface of the wash tub. Preferably, the means for mounting the device within the wash tub is by a clamp attached to the device. The clamp is configured to engage with a wall of the wash tub. Alternatively, the means for mounting the device within the wash tub may also be a section of Velcro™ material i.e., hook and loop-type material attached to the device which mates with a section of Velcro™ material attached to the wash tub.

Preferably, the front end of the housing is wider than the second end of the housing. The drain passage is also wider at the first end of the housing than at the second end. The wider end of the housing having the wider drain passage is referred to as the liquid receiving portion, which opens at the receiving opening of the housing. The more narrow second end of the housing having the more narrow drain passage is referred to as the drain portion. The drain portion opens at the engagement opening of the housing. Thus, fluid that enters the receiving portion at the receiving opening of the housing travels down the drain passage through the receiving portion and through the drain portion and out of the engagement opening of the housing.

It is preferred that the dispensing device have adapted thereto a fluid communication means between the receiving opening of the housing and the automatic washing machine. Preferably a hose connects the housing receiving opening to the washing machine. The dispensing device also preferably includes a valve for the fluid communication means which allows fluid to travel alternatively to the housing or to the wash tub.

The dispensing device also preferably has an overflow channel that is provided on the housing, proximate to the receiving opening of the housing. The overflow channel is sized, configured and positioned so that when fluid rises to a selected level within the wash tub, fluid will travel in the overflow channel, down the housing and down the drain.

Other objects and advantages of the invention will become apparent from a description of certain present preferred embodiments thereof shown in the drawings.

DESCRIPTION OF THE PREFERRED EMBODIMENT

Figure 1:
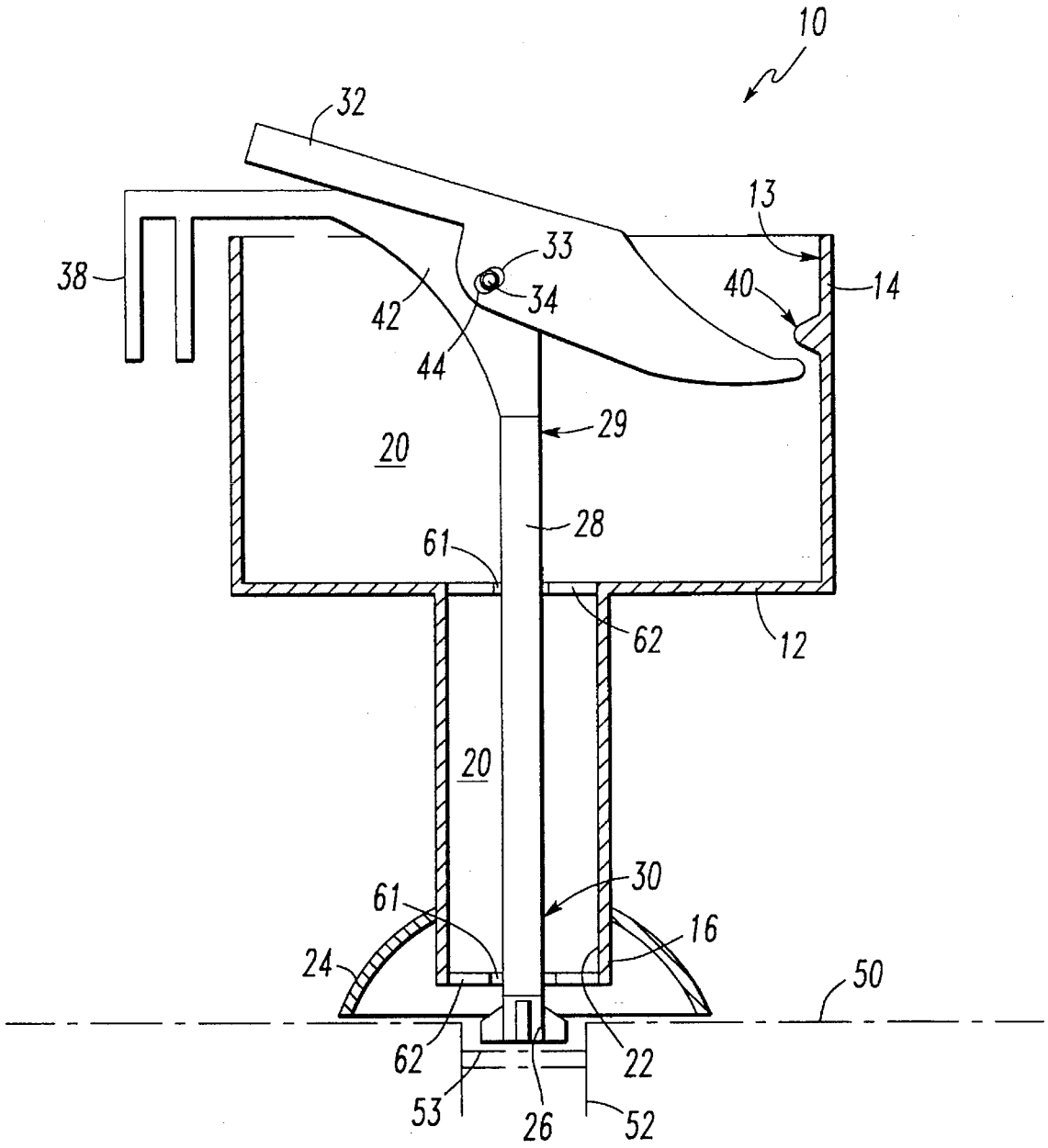
FIG. 1 is an elevational view taken partially in cross section of the present preferred dispensing device.
Figure 2:
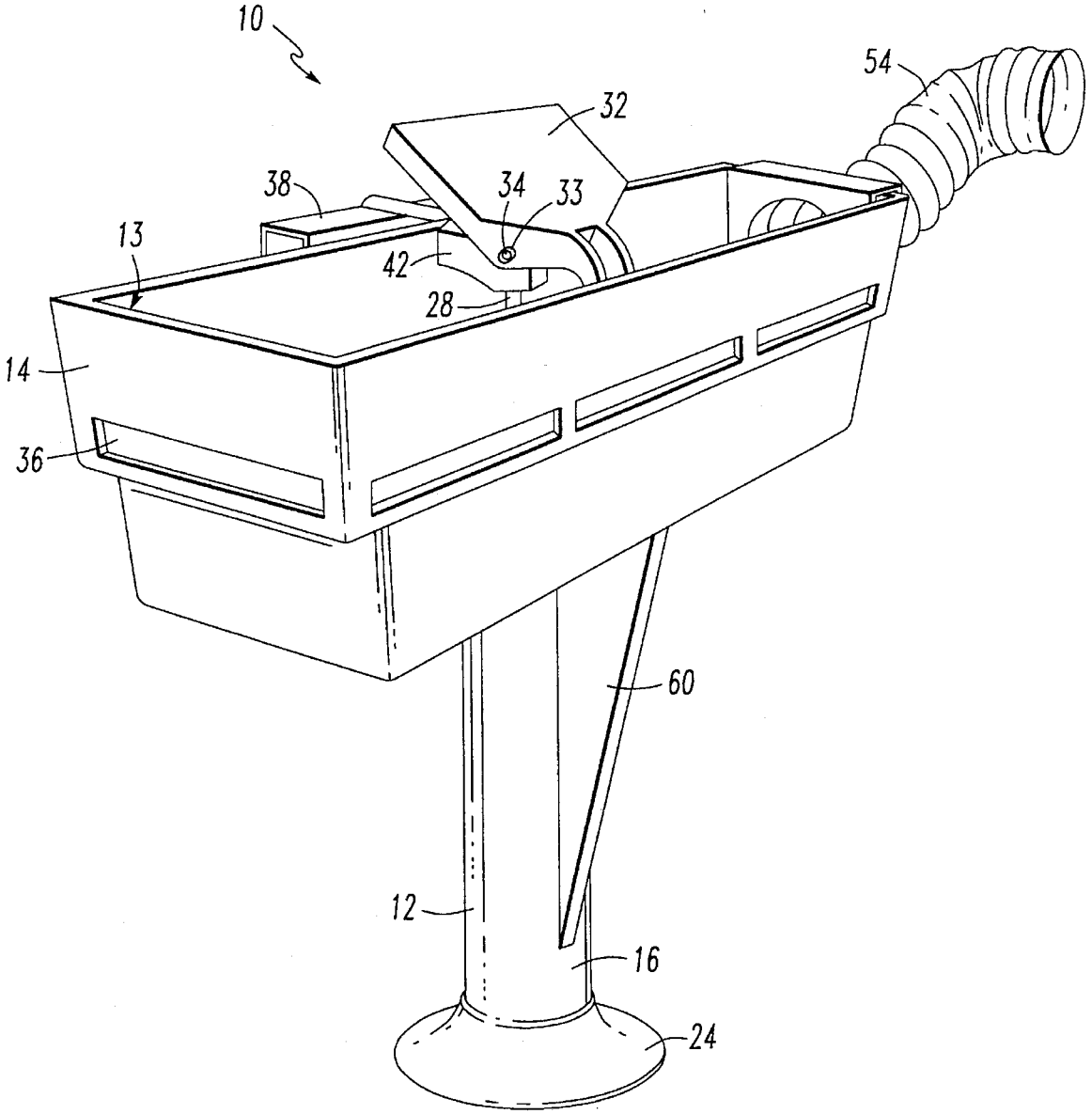
FIG. 2 is a perspective view of the present preferred dispensing device.

Referring first to FIGS. 1 and 2, the present preferred dispensing device is shown. The dispenser device 10 has an elongated housing 12. The housing 12 is hollow so as to have a drain passage 20 disposed through the housing 12. The housing 12 further has a first end 14 and a second end 16. A receiving opening 13 is provided at the first end 14 of housing 12 which connects with the drain passage 20. An engagement opening 22 is provided at the second end 16 of the housing 12 which also connects with the drain passage 20. A seal gasket 24 is provided around the second end 16 of the housing 12 proximate the engagement opening 22.

The housing 12 and the drain passage 20 may be of uniform dimensions, such as a cylindrical tube. Preferably, however, the housing 12 is wider at the first end 14 of the housing 12 than at the second end 16 of the housing 12. Also, the drain passage 20 is preferably wider at the first end 14 of the housing 12 than at the second end 16 of the housing 12. The first end 14 of the housing having the receiving opening 13 is referred to as the receiving portion while the more narrow portion of the housing 12 at the second end 16 of the housing 12 is referred to as the drain portion. One or more webs 60 may be provided upon the housing 12 in order to offer additional support for the housing 12 of the device.

The device 10 is capable of being selectively placed into sealed or unsealed positions. When the device 10 is placed into the sealed position, the sealing gasket 24 contacts and makes a seal with the wash tub (shown in dotted line and designated as 50 in FIG. 1) around the wash tub drain (designed as 52 in FIG. 1). With the sealing gasket 24 thus placed around the tub drain 52, fluid that enters the receiving opening 13 of the housing 12 travels through the drain passage 20, out of the engagement opening 22 and down the wash tub drain 52. Also, when the sealing gasket 24 is thus sealingly positioned around the tub drain 52, fluid that enters the wash tub 50 is stored in the wash tub 50 and is prevented from traveling down the wash tub drain 52 by the device 10.

When the device 10 is placed in the unsealed position, the sealing gasket 24 is separated from the wash tub 50 and the wash tub drain 52. With the sealing gasket 24 thus removed from contact with the wash tub 50, fluid that enters either the wash tub 50 or the receiving opening 13 of the housing 12 travels down the wash tub drain 52.

The preferred means for placing the device 10 into the sealed and unsealed positions involves a guide rod 28 and a lever system. The elongated guide rod 28 has a first end 29 and a second end 30. The guide rod 28 is disposed within the housing 12 with the guide rod 28 and the housing 12 being movable with respect to one another. The guide rod 28 is permitted to move longitudinally relative to the housing 12 but is prevented from being moved any substantial amount laterally by collars 62 provided within the drain passage 20. The collars 62 have an opening 63 disposed therethrough through which the guide rod 28 is disposed. Preferably, the guide rode is generally cylindrical so that the collar opening 63 is circular. The collars 62 are size and configured (such as by being perforated or having openings sufficiently provided therethrough) to allow fluid to pass through substantially unrestricted.

The second end 30 of the guide rod 28 is positioned upon the drain 52 of the washer tub 50. Drains are typically constructed so as to have a restricting surface 53 through which fluids may pass but larger objects may not. It is upon this restricting surface which the second end 30 of the guide rod 28 preferably rests.

The second end 30 of the guide rod 28 is positioned upon the washer tub drain 52 either directly or by having an anchor 26 connected to the second end 30 of the guide rod 28. The anchor 26 is sized and configured to engage with the washer tub drain 52 while allowing fluid to travel past the anchor 26 and go down the tub drain 52. Alternatively, the second end 30 of the guide rod 28 may rest upon the bottom interior of the wash tub 50 around and upon the wash tub drain 52.

A lever handle 32 is pivotally connected to the first end 29 of the guide rod 28. When the lever handle 32 is pivoted, the lever handle 32 contacts the housing 12. Thus, when the lever handle 32 is pivoted, the guide rod second end 30 maintains contact with the tub drain 52 and the lever handle 32 contacts the housing 12, lifting the housing 12 and moving the sealing gasket 24 away from the tub drain 52 and moving the device 10 into the unsealed position.

The lever handle 32 is pivotally connected to the first end 29 of the guide rod 28, preferably through a pivotal mounting 42. The pivot mounting 42 is preferably attached to the first end 29 of the guide rod 28. The pivot mounting 42 further preferably has a pin opening 44 disposed therethrough to receive a pivot pin 34. The lever handle 32 is then engaged to the pivot pin 34 by the pivot pin 34 being disposed through a pivot opening 33 on the lever handle 32.

The lever handle 32, upon being pivoted, preferably makes contact with the housing 12 at a raised portion or ledge 40 of the housing 12 to ensure adequate contact between the lever handle 32 and the housing 12 to allow the housing 12 to be lifted. However, contact between the lever handle 32 and the housing 12 may also occur at an indentation (not shown) provided upon housing 12 such that the lever handle 32 mates with the indentation, providing an adequate contact between the lever handle 32 and the housing 12. Of course, the lever handle 32 may also contact the housing 12 along a flat surface of housing 12.

An overflow channel 36 is provided upon the first end 14 of the housing 12, proximate to the housing receiving opening 13. The overflow channel 36 may be a hole or opening provided through the housing 12 (as depicted in FIG. 2) or may be a notch taken from the first end 14 of the housing 12 adjacent to the receiving opening 13. In any event, the overflow channel is sized, configured and positioned so that if fluid rises to a predetermined level within the wash tub 50, fluid will enter into the housing 12 through the overflow channel 36 and will travel down the wash tub drain 52.

Figure 3:
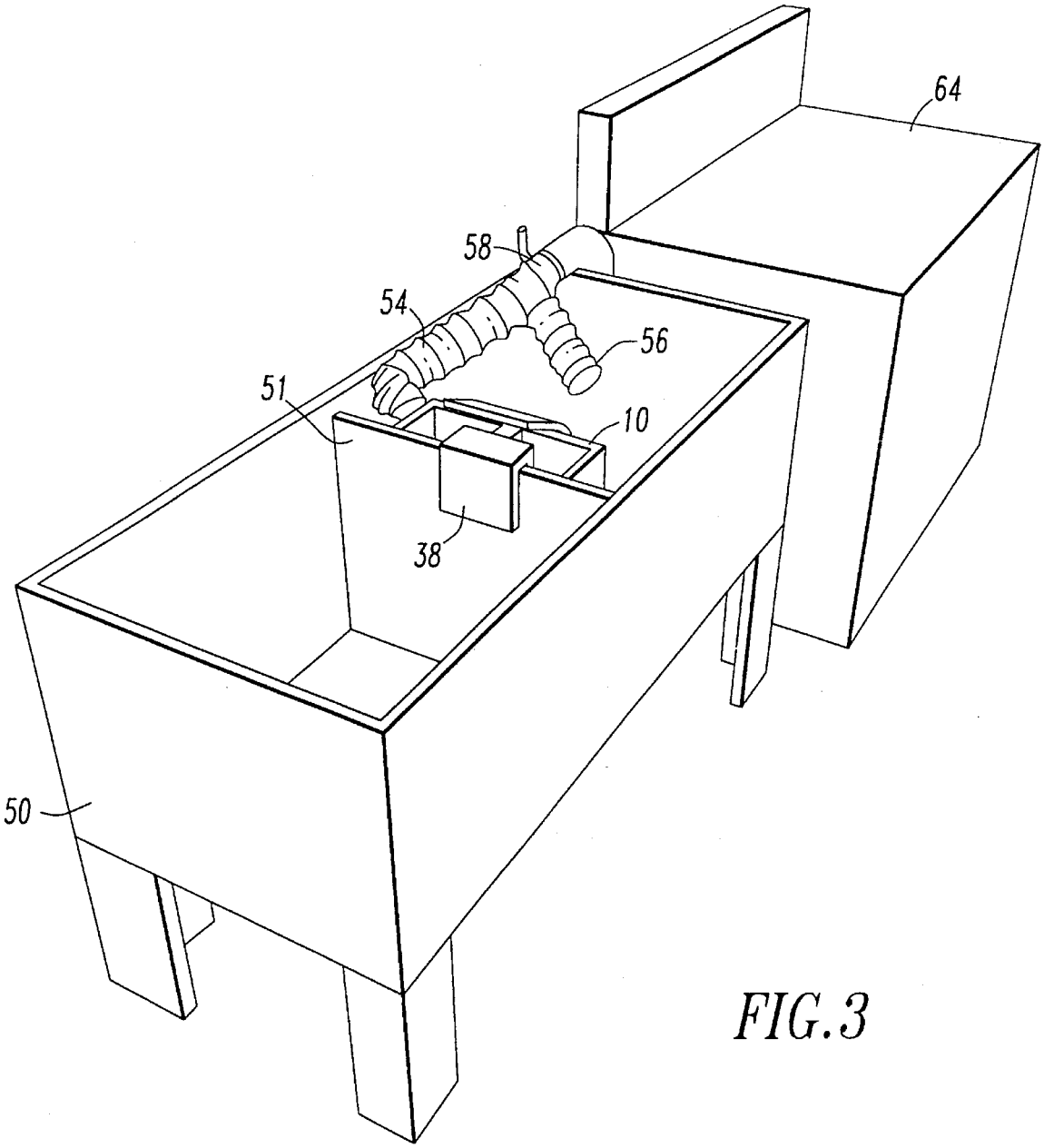
FIG. 3 is a perspective view of an automatic washer and washer tub showing the device connected thereto.

Referring next to FIG. 3, the device 10 is mounted within the wash tub 50 by any convenient means. Wash tubs 50 typically have walls 51 defining the area in which fluid may be retained. Often, wash tubs 50 have two such fluid retaining areas that are separated by a wall 51.

The preferred means for mounting the device 10 within the wash tub 50 is by a clamp 38 attached to the device 10. Thus, the clamp 33 of the device will engage with a wall 51 of the wash tub 50. Alternatively, the means for mounting the device 10 within the wash tub 50 may also be a section of Velcro material attached to the device 10 that is matable with a section of Velcro material attached to the wash tub 50. Whichever means are selected for securing the device 10 to the wash tub, the device 10 should be positioned so that the device 10 may engage the drain 52 of the wash tub 50.

As described above, the preferred means of placing the device 10 into sealed and unsealed positions involves the use of a guide rod 28 which engages with the drain 52 and the wash tub 50. Because the position of the guide rod 28 remains relatively fixed in both the sealed and unsealed positions and because the housing 12 moves relative to the wash tub 50, it is preferred that the means for mounting the device 10 to the wash tub 50 be connected to the guide rod 28 rather than to the housing 12, regardless of the type of mounting means that is selected.

The device 10 is preferably in fluid communication with the automatic washing machine 64. A hose 54 connects the automatic washing machine 64 to the device 10. Thus, fluid which exits the automatic washing machine 64 travels through hose 54 and into the device 10 down the drain 52 of the wash tub 50. A hose connection 56 branches off of hose 54 and directs fluid from the washing machine 64 directly into the wash tub 50. It is preferred that a valve means 58 is provided which may selectively allow fluid from the washing machine 64 to travel either through hose 54 into the device 10 or through hose connection 56 into the wash tub 50. Such valves which may direct fluid from a single line into either of two lines are generally known. Alternatively, hose 54 may be designed so as to be in fluid communication with the device or removed from the device 10. Thus, in this alternative one operating the device would manually direct hose 54 either into the device 10 or into the wash tub 50. In this alternative, a hose connection 56 is not needed.

While certain present preferred embodiments have been shown and described, it is distinctly understood that the invention is not limited thereto but may be otherwise embodied within the scope of the following claims.

I claim:

1. A dispenser device for use with an automatic washing machine operable through a sequence of washing operations in a wash cycle and a wash tub having a drain, the device comprising:

an elongated housing having a drain passage disposed therethrough; said housing further having a first end provided with a first opening and a second end provided with a second opening, wherein said openings are both connected to said drain passage;

a sealing gasket provided around said housing second end proximate said second opening;

means for mounting said device within the wash tub;

means for selectably placing the device into a sealed and an unsealed position, wherein when said device is in said sealed position, said sealing gasket makes sealing contact with the wash tub around the wash tub drain such that .fluid that enters said first opening travels through said drain passage down the wash tub drain while fluid that enters the wash tub is stored in the wash tub and prevented from travelling down the wash tub drain by the device; and wherein when said device is in said unsealed position, said sealing gasket is separated from the wash tub such that fluid that enters the wash tub and fluid that enters said first opening travels down the wash tub drain;

fluid communication means between said housing first opening and the automatic washing machine; and a valve means for said fluid communication means of said device, wherein said valve means allow fluid to travel alternatively into said first opening and into the wash tub.

2. A dispenser device for use with an automatic washing machine operable through a sequence of washing operations in a wash cycle and a wash tub having a drain, the device comprising:

an elongated housing having a drain passage disposed therethrough; said housing further having a first end provided with a first opening and a second end provided with a second opening, wherein said openings are both connected to said drain passage;

a sealing gasket provided around said housing second end proximate said second opening;

means for mounting said device within the wash tub;

means for selectably placing the device into a sealed and an unsealed position, wherein when said device is in said sealed position, said sealing gasket makes sealing contact with the wash tub around the washtub drain such that fluid that enters said first opening travels through said drain passage down the wash tub drain while fluid that enters the wash tub is stored in the wash tub and prevented from travelling down the wash tub drain by the device; and wherein when said device is in said unsealed position, said sealing gasket is separated from the wash tub such that fluid that enters the wash tub and fluid that enters said first opening travels down the wash tub drain; and an overflow channel provided at said housing first end such that when fluid reaches a selected level within said wash tub, fluid will travel into said overflow channel.

3. A dispenser device for use with an automatic washing machine operable through a sequence of washing operations in a wash cycle and a wash tub having a drain, the device comprising:

an elongated housing having a drain passage disposed therethrough: said housing further having a first end provided with a first opening and a second end provided with a second opening, wherein said openings are both connected to said drain passage; wherein said housing comprises a liquid storage portion and a hollow drain portion; wherein said liquid storage portion opens at said housing first opening, and said liquid storage portion has a drain opening disposed therein; and wherein one end of said drain portion connects to said liquid storage portion at said drain opening, and an opposite end of said drain portion opens at said housing second opening;

a sealing gasket provided around said housing second end proximate said second opening;

means for mounting said device within the wash tub;

means for selectably placing the device into a sealed and an unsealed position, wherein when said device is in said sealed position, said sealing gasket makes sealing contact with the wash tub around the wash tub drain such that fluid that enters said first opening travels through said drain passage down the wash tub drain while fluid that enters the wash tub is stored in the wash tub and prevented from travelling down the wash tub drain by the device; and wherein when said device is in said unsealed position, said sealing gasket is separated from the wash tub such that fluid that enters the wash tub and fluid that enters said first opening travels down the wash tub drain.

4. A dispenser device for use with an automatic washing machine operable through a sequence of washing operations in a wash cycle and a wash tub having a drain, the device comprising:

an elongated housing having a drain passage disposed therethrough; said housing further having a first end provided with a first opening and a second end provided with a second opening, wherein said openings are both connected to said drain passage;

a sealing gasket provided around said housing second end proximate said second opening;

means for mounting said device within the wash tub;

means for selectably placing the device into a sealed and an unsealed position, wherein when said device is in said sealed position, said sealing gasket makes sealing contact with the wash tub around the wash tub drain such that fluid that enters said first opening travels through said drain passage down the wash tub drain while fluid that enters the wash tub is stored in the wash tub and prevented from travelling down the wash tub drain by the device: and wherein when said device is in said unsealed position, said sealing gasket is separated from the wash tub such that fluid that enters the wash tub and fluid that enters said first opening travels down the wash tub drain; wherein said means for selectably placing the device into a sealed and an unsealed position comprises:

(i) an elongated guide rod having a first end and a second end, said guide rod disposed within the housing such that said guide rod and said housing are movable relative to one another;

(ii) a lever handle pivotally connected to the first end of said guide rod, and having a portion that contacts said housing when lever handle is pivoted;

(iii) wherein said guide rod second end rests upon the drain of the washer tub, and when said lever handle is pivoted said lever handle contacts said housing, lifting said housing and moving said sealing gasket away from the tub drain.

5. The device of claim 4 further comprising an anchor mounted to said guide rod second end, wherein said anchor is sized and configured to allow fluid to pass therethrough.

6. The device of claim 1 further comprising an overflow channel provided at said housing first end such that when fluid reaches a selected level within said housing, fluid will travel out of said overflow channel.

7. The device of claim 1 wherein said housing comprises a liquid storage portion and a hollow drain portion; wherein said liquid storage portion opens at said housing first opening, and said liquid storage portion has a drain opening disposed therein; and wherein one end of said drain portion connects to said liquid storage portion at said drain opening, and an opposite end of said drain portion opens at said housing second opening.

8. The device of claim 1 wherein said means for selectably placing the device into a sealed and an unsealed position comprises:

an elongated guide rod having a first end and a second end, said guide rod disposed within the housing such that said guide rod and said housing are movable relative to one another;

a lever handle pivotally connected to the first end of said guide rod, and having a portion that contacts said housing when lever handle is pivoted;

wherein said guide rod second end rests upon the drain of the washer tub, and when said lever handle is pivoted, said lever handle contacts said housing, lifting said housing and moving said sealing gasket away from the tub drain.

9. The device of claim 2 further comprising fluid communication means between said housing first opening and the automatic washing machine; and a valve means for said fluid communication means of said device, wherein said valve means allow fluid to travel alternatively into said first opening and into the wash tub.

10. The device of claim 2 wherein said housing comprises a liquid storage portion and a hollow drain portion; wherein said liquid storage portion opens at said housing first opening, and said liquid storage portion has a drain opening disposed therein; and wherein one end of said drain portion connects to said liquid storage portion at said drain opening, and an opposite end of said drain portion opens at said housing second opening.

11. The device of claim 2 wherein said means for selectably placing the device into a sealed and an unsealed position comprises:

an elongated guide rod having a first end and a second end, said guide rod disposed within the housing such that said guide rod and said housing are movable relative to one another:

a lever handle pivotally connected to the first end of said guide rod, and having a portion that contacts said housing when lever handle is pivoted;

wherein said guide rod second end rests upon the drain of the washer tub, and when said lever handle is pivoted said lever handle contacts said housing, lifting said housing and moving said sealing gasket away from the tub drain.

12. The device of claim 3 further comprising fluid communication means between said housing first opening and the automatic washing machine; and a valve means for said fluid communication means of said device, wherein said valve means allow fluid to travel alternatively into said first opening and into the wash tub.

13. The device of claim 3 further comprising an overflow channel provided at said housing first end such that when fluid reaches a selected level within said housing, fluid will travel out of said overflow channel.

14. The device of claim 3 wherein said means for selectably placing the device into a sealed and an unsealed position comprises:

an elongated guide rod having a first end and a second end, said guide rod disposed within the housing such that said guide rod and said housing are movable relative to one another;

a lever handle pivotally connected to the first end of said guide rod, and having a portion that contacts said housing when lever handle is pivoted;

wherein said guide rod second end rests upon the drain of the washer tub, and when said lever handle is pivoted, said lever handle contacts said housing, lifting said housing and moving said sealing gasket away from the tub drain.

15. The device of claim 4 further comprising fluid communication means between said housing first opening and the automatic washing machine; and a valve means for said fluid communication means of said device wherein said valve means allow fluid to travel alternatively into said first opening and into the wash tub.

16. The device of claim 4 further comprising an overflow channel provided at said housing first end such that when fluid reaches a selected level within said housing, fluid will travel out of said overflow channel.

17. The device of claim 4 wherein said housing comprises a liquid storage portion and a hollow drain portion; wherein said liquid storage portion opens at said housing first opening, and said liquid storage portion has a drain opening disposed therein; and wherein one end of said drain portion connects to said liquid storage portion at said drain opening, and an opposite end of said drain portion opens at said housing second opening.

* * * * *